US009528806B2

(12) United States Patent
Rossmann et al.

(10) Patent No.: US 9,528,806 B2
(45) Date of Patent: Dec. 27, 2016

(54) PROJECTILE HAVING A DISCARDABLE SABOT

(71) Applicants: RWM SCHWEIZ AG, Zürich (CH); RHEINMETALL WAFFE MUNITION GMBH, Unterluss (DE)

(72) Inventors: Rudolf Rossmann, Zürich (CH); Kai Ketelhut, Zürich (CH); Andreas Blache, Lörrach (DE)

(73) Assignees: RWM SCHWEIZ AG, Zürich (CH); RHEINMETALL WAFFE MUNITION GMBH, Unterlüss (DE)

( * ) Notice: Subject to any disclaimer, the term of this patent is extended or adjusted under 35 U.S.C. 154(b) by 0 days.

(21) Appl. No.: 13/834,812

(22) Filed: Mar. 15, 2013

(65) Prior Publication Data

US 2013/0312631 A1 Nov. 28, 2013

Related U.S. Application Data

(63) Continuation-in-part of application No. PCT/EP2011/004185, filed on Aug. 19, 2011.

(30) Foreign Application Priority Data

Sep. 16, 2010 (DE) ..... 10 2010 045 474

(51) Int. Cl.
*F42B 14/06* (2006.01)

(52) U.S. Cl.
CPC ..... *F42B 14/064* (2013.01); *F42B 14/06* (2013.01)

(58) Field of Classification Search
CPC ..... F42B 14/06; F42B 14/061; F42B 14/064; F42B 14/067
USPC ..... 102/520, 521, 522, 523
See application file for complete search history.

(56) References Cited

U.S. PATENT DOCUMENTS

| | | | | | |
|---|---|---|---|---|---|
| 3,496,869 | A | * | 2/1970 | Engel | 102/522 |
| 3,927,618 | A | * | 12/1975 | Engel | 102/522 |
| 4,517,899 | A | * | 5/1985 | Haberli | 102/521 |
| 4,776,280 | A | * | 10/1988 | Burri et al. | 102/523 |
| 4,846,072 | A | | 7/1989 | Rossmann | |
| 5,388,523 | A | * | 2/1995 | Rossmann | 102/521 |
| 5,404,816 | A | | 4/1995 | Burri | |

(Continued)

FOREIGN PATENT DOCUMENTS

| | | |
|---|---|---|
| DE | 86 13 685 U1 | 8/1987 |
| EP | 0 645 600 A1 | 8/1994 |

OTHER PUBLICATIONS

International Search Report issued in corresponding application PCT/EP2011/004185, completed Jan. 10, 2012 and mailed Jan. 17, 2012.

(Continued)

*Primary Examiner* — James S Bergin
(74) *Attorney, Agent, or Firm* — Griffin & Szipl, P.C.

(57) ABSTRACT

The invention relates to a sabot (4) for a sub-caliber projectile (1) having a projectile core (2). When the projectile exits a weapon barrel, the sabot detaches from the projectile core (2) without transferring momentum by means of a separating aid (4) incorporated between the projectile core (2) and the sabot. The separating aid (4) has a plurality of fingers (5) having at least one predetermined breaking point (8*a*, 8*b*), which is connected to the projectile core (2) by a type of snap-connection bead (6) on the fingers/braces (5).

19 Claims, 4 Drawing Sheets

(56) References Cited

U.S. PATENT DOCUMENTS 5,902,955 A * 5/1999 Rossmann ..... 102/521
6,324,986 B1 * 12/2001 Rossmann et al. ..... 102/521

OTHER PUBLICATIONS

Wasser, Guido J., Kleines Lexikon über Waffen and Munition—Nicht Nur für Metallsilhouetten-Schützen, Mar. 3, 2004.
Teachers' manual, University-based Physics Laboratory, Department of Physics and Astronomy, Utrecht University, at http://www.staff.science.uu.nl/~kortl101/ubl_1-01-3_air-resist_manual-te.pdf (downloaded Mar. 5, 2013).
Weerstandscoëfficiënt, at http://nl.wikipedia.org/wiki/Weerstandsco%C3%ABffici%C3%ABnt (downloaded Mar. 5, 2013), with a partial Wikipedia English translation.

* cited by examiner

PROJECTILE HAVING A DISCARDABLE SABOT

This is a Continuation-in-Part Application in the United States of International Patent Application No. PCT/EP2011/004185 filed Aug. 19, 2011, which claims priority on German Patent Application No. DE 10 2010 045 474.5, filed Sep. 16, 2010. The entire disclosures of the above patent applications are hereby incorporated by reference.

FIELD OF THE INVENTION

The invention relates to a projectile having a discardable sabot for sub-caliber munitions, which is fired from a weapon tube or barrel equipped with angular grooves (e.g., rifling grooves of a rifled weapon tube).

BACKGROUND OF THE INVENTION

It is known that an asymmetrical or uneven separation and discarding of the sabots, or their segments, leads to a malfunction in discharge ballistics. The reason for this lies, among others, in (i) the premature opening of the back of the sabot inside the weapon tube or barrel and (ii) other than optimal tearing at the predetermined breaking points, following exit from the weapon tube or barrel. Another major problem is the anchoring of the sabot to the guided projectile and/or a penetrator. It is possible that, as a result of the gas pressure of the propellant (i.e., a propellant powder) during firing and the thereby produced axial or radial acceleration force on the missile in the tube, the projectile is shattered in the weapon tube or barrel.

For transmission of force and separation function for discharge ballistics, so-called "separation aids" are employed according to the state of the art, such as, for example, collars may be used as separation aids. Between the sabot and the penetrator/projectile, a part is installed that is anchored to the penetrator/projectile, for example, by means of threads. By means of grooves on the exterior of the separation aid, the surface is enlarged, as a result of which the sabot is afforded more force transmission surface (i.e., a greater force transmission area). As a result of the angular grooves (rifling grooves) inside the weapon tube or barrel, the projectile is set in rotation during firing. During exit from the weapon tube or barrel, the sabot with the assistance of the separation aid, based on centrifugal force, tears at its predetermined breaking points and is discarded. Unfortunately, this event does not occur symmetrically, i.e., the opening or tearing of the breaking points is asymmetrical. As a result, the penetrator receives an impulse during ejection, resulting in potential wobbling or oscillation and diminished target accuracy. Another negative point during opening (separation) can be the premature opening or separation inside the weapon tube/barrel, so that the entire separation and discard process malfunctions and the projectile and/or the penetrator likewise receive a negative impulse. Even though the threading generally satisfies the transfer function and, thereby, the transmission of force, the air friction coefficient, namely, the $c_w$ value, is worsened in connection with the separation aid, so the mass of the projectile/penetrator is reduced and, thereby, the impact on the target is reduced. Moreover, the manufacture of threading is expensive, which results in higher costs.

A discardable sabot is known from EP 0 645 600 A1 for a sub-caliber projectile, which is of one piece and made of plastic. The sabot has longitudinal grooves up to a gas sealing region at the end of a guidance band. In the basic groove region, the longitudinal grooves have enlargements in cross-section, as a result of which segments are formed, which are connected with each other by corresponding predetermined breaking points. Both elements, namely, the quantity of the pre-determined breaking points as well as the plastic material produce smaller plastic splinters or fragments during detachment of the sabot from the body of the projectile.

Based on the conventional sabot described above, the present invention seeks to generally improve the separation function and the transfer function, and specifically seeks to improve anchoring of the sabot in the rear of the projectile.

SUMMARY OF THE INVENTION

The means for attaining the object of the invention are the characteristics of a first non-limiting embodiment of the present invention, which pertains to a sabot (3) for a projectile (1) with a sub-caliber projectile core (2), characterized by a separation aid (4) integrated between the projectile bottom (2.1) and the sabot (3) for separating the sabot (3) from the projectile core (2), and which presents a plurality of fingers (5) contacting the projectile core (2), which are connected with each other via a supporting surface or ring (10) below the bottom of the projectile core (2.1) as well as at least one predetermined breaking point (8*a*, 8*b*) provided in the fingers (5). Beneficial additional non-limiting embodiments are summarized as follows.

In accordance with a second non-limiting embodiment of the present invention, the first non-limiting embodiment is modified so that the fingers (5) contact the projectile core (2) via an interior bulge or bead (6). In accordance with a third non-limiting embodiment, in accordance with the present invention, the first or second non-limiting embodiments are modified so that the fingers (5) have a number of grooves (7) whose shapes can represent or copy different geometric arrangements. In accordance with a fourth non-limiting embodiment of the present invention, the third non-limiting embodiment is further modified so that the grooves (7) have an angular shape, so that the groove forms can range, for example, in a combination from triangular (7*e*) up to multi-angular (7*f*), and combined with pointed, rounded-off and/or beveled edges, etc.

In accordance with a fifth non-limiting embodiment of the present invention, the first second, third and fourth non-limiting embodiments are further modified so that additional grooves (11) are located below the supporting or contact surface (10). In accordance with a sixth non-limiting embodiment of the present invention, the first, second, third, fourth and fifth non-limiting embodiments are further modified so that the supporting surface (10) is horizontal, inclined (oblique) and/or rounded-off (rounded). In accordance with a seventh non-limiting embodiment of the present invention, the first, second, third, fourth, fifth and sixth non-limiting embodiments are further modified so that the shape of the fingers (5) is variable relative to the cross-section, so that they can be pointed towards the center, parallel to each other relative to the center and/or pointed to the exterior. In accordance with an eighth non-limiting embodiment of the present invention, the first, second, third, fourth, fifth, sixth and seventh non-limiting embodiments are further modified so that the number as well as the length of the fingers (5) is dependent upon the diameter as well as the length of the projectile core (2).

Generally, the invention is based on the concept of integrating or incorporating a separation aid with a sabot and a projectile, which facilitates improved detachment of the sabot from the projectile. The separation aid is, in turn, preferably integrated in the bottom region between the projectile core and the sabot and comprises, at the bottom or floor of the separation aid, vertical fingers/braces with predetermined breaking points. The fingers themselves preferably have an inner bulge or bead in the upper region, by means of which the sabot can be connected with the missile core (projectile/penetrator) by a snap-connection. The projectile/penetrator is supported by, or rests on, the side of the bottom/ring of the separation aid. At the fingers and at the bottom are arranged grooves, or the like, providing a hold for the sabot.

During firing, the bottom of the separation aid supports the hold of the projectile core in the sabot in an axial direction. The rear of the sabot is anchored at the bottom and is not able to open prematurely or separate prematurely, while in the weapon tube or barrel so the transfer function or driving function is improved. During exit from the weapon tube or barrel, the bottom and the fingers support symmetrical tearing and discarding of the sabot, as a result of which almost no impulse impact remains with respect to the projectile/penetrator, so separation function is improved.

In addition to the improvement in the separation function as well as in the transfer or driving function, the target accuracy also increases as a result of the almost impulse-free detachment of the sabot. Another benefit lies in the fact that the plastics extrusion method (plastic injection process), or the process of extruding plastic material (plastic injection molding), of the sabot decreases or even loses influence with respect to target accuracy.

BRIEF DESCRIPTION OF THE DRAWINGS

A more detailed explanation is given of the invention based on an exemplary embodiment with drawings, such as illustrated by:

FIGS. 6 to 8 show geometrical illustrations of the grooves of the separation aid;

DETAILED DESCRIPTION OF THE INVENTION

Figure 1:
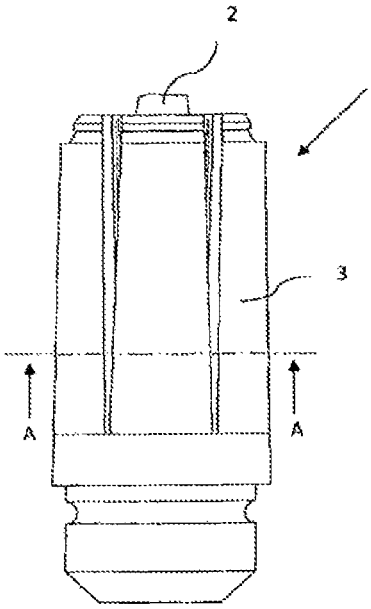
FIG. 1, which shows an illustration of a projectile in accordance with the present invention.
Figure 2:
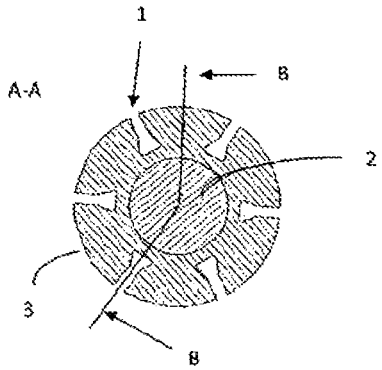
FIG. 2, which shows an illustration of Section A-A from FIG. 1.
Figure 3:
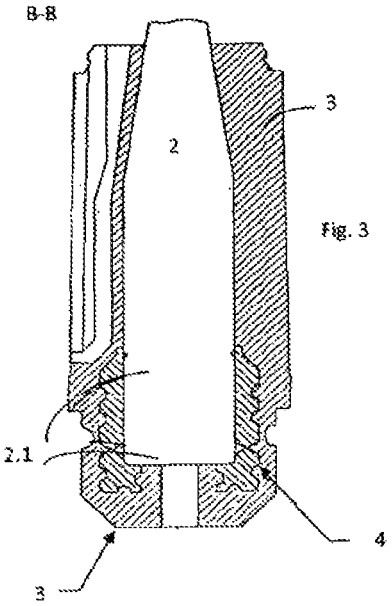
FIG. 3, which shows an illustration of Section B-B from FIG. 2.

FIG. 1 depicts a projectile 1 provided with a projectile core 2 (i.e., a penetrator or projectile component), wherein the projectile core 2 is enclosed by a sabot 3. FIG. 2 depicts the projectile 1 in sectional view A-A from FIG. 1, and FIG. 3 depicts the sectional view B-B of the projectile from FIG. 2. Between the projectile core 2 and the sabot 3 is integrated, or arranged, a so-called separation aid 4 in the projectile bottom region 2.1 as shown in FIG. 3.

Figure 4:
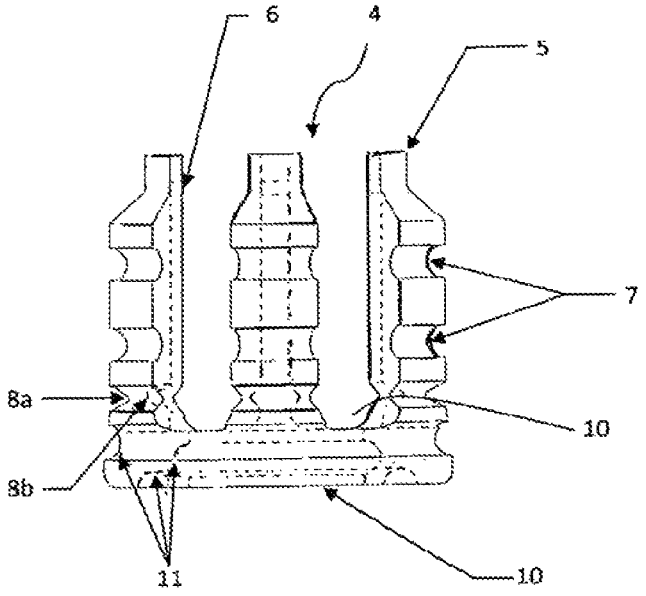
FIG. 4, which shows a lateral illustration of a separation aid from FIG. 3.
Figure 5:
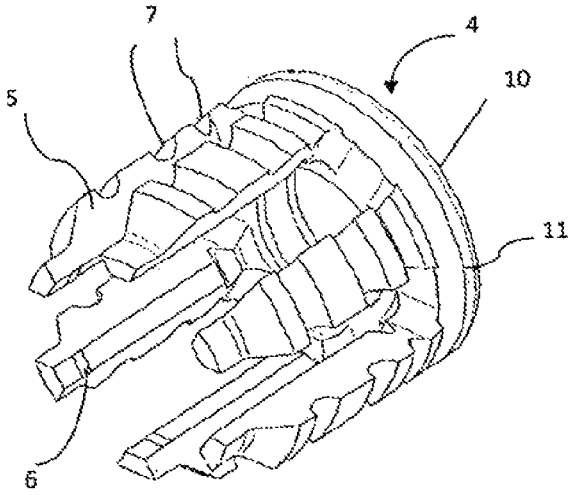
FIG. 5, which shows a perspective illustration of the separation aid from FIG. 3 and FIG. 4.

FIG. 4 and FIG. 5 depict an embodiment of the separation aid with six fingers 5, which are connected with each other by means of a ring or supporting surface 10. The separation aid 4 is attached to the core 2 by means of a bulge or bead 6 at the fingers 5. As shown in FIG. 5, the bulges/beads 6 are located on an interior side of the fingers 5, and each bulge or bead 6 is preferably integrated in the upper region of its corresponding finger 5. The number of fingers 5 can vary, whereby, in particular, the number of fingers 5 should depend upon the diameter of the core 2. For example, for small diameter cores the number of fingers employed may be less than for large diameter cores. Each finger 5 comprises at least one groove, although preferably however each finger 5 has a plurality of grooves 7 formed on an exterior side. Here, also, the number of grooves can be selected at will and should also be made dependent in this instance upon the length of the fingers 5. More specifically, the number of grooves may be increased for longer fingers.

Figure 8:
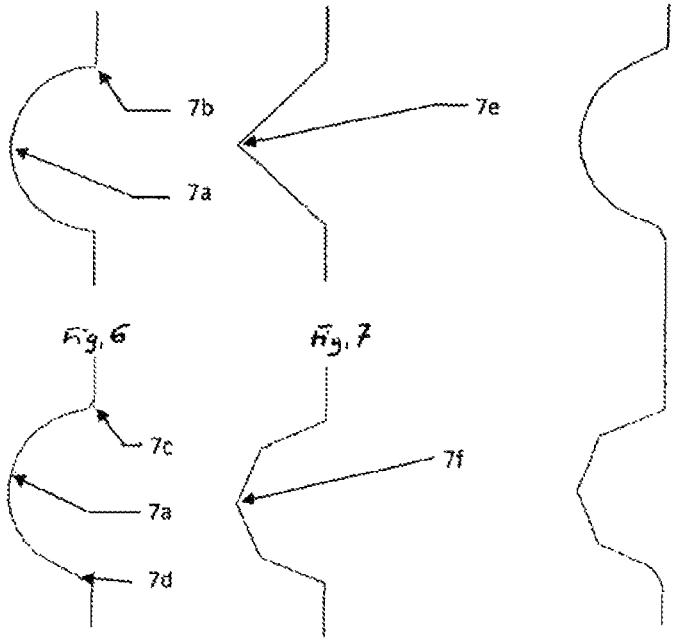

The form (shape) of the grooves likewise may be varied. In FIG. 6, groove 7*a* is round and groove edge 7*b* designed as sharp edge. Thus, the groove in FIG. 6 has a semi-circular contour. Grooves 7 can thus be sharp-edged, 7*b*, or have a rounded-off edge, 7*c*, or have a beveled edge, 7*d*, as shown in FIG. 6. An angular shape of the groove(s) 7 is also possible, so that the groove shapes can be combined, for example, ranging from triangular contoured, 7*e*, as shown in FIG. 7, up to multi-angular or polygonal contoured, 7*f*, with sharp edges, rounded-off edges and/or beveled edges, etc., such as depicted in FIG. 8.

Figure 9:
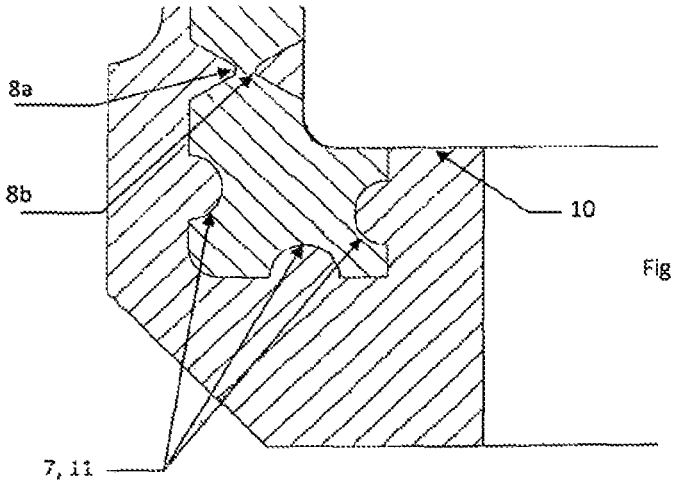
FIG. 9 shows an enlarged illustration of the integration of the predetermined breaking points in the separation aid.

Under the contact surface 10 of the separating aid 4 for the core 2 are preferably also arranged grooves 11 such as shown in FIG. 4 and in FIG. 9. The shape and number of these grooves 11 is variable, in keeping with the shape and number of grooves 7 formed on or in the fingers 5. The same is true for the edges of grooves 9, which may have varied shapes in accordance with the edge shapes described above with respect to grooves 7, which means that they may be sharp edges, rounded-off edges and/or beveled edges, etc.

For the separation function, the separation aid 4 at the fingers 5 is provided with at least one pair of breaking points 8*a*, 8*b* (FIG. 9); preferably, however, the fingers 5 are provided with a plurality of predetermined breaking points. The form of the predetermined breaking points 8*a*, 8*b* can assume that of the grooves 7, for example, which means that they may have semi-circular contours, triangular contours, or multi-angular contours. In addition, the exterior or outer predetermined breaking points 8*a* and the interior or inner predetermined breaking points 8*b* can have a differing shape, equivalent to grooves 7 and their edges, such as shown in the various embodiments of FIGS. 6 to 8. Additional predetermined breaking points may also be provided in the supporting or contact surface 10 (not described in more detail).

Figure 10:
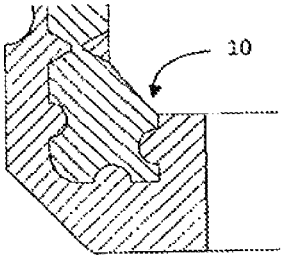
FIGS. 10 and 11 show possible shapes of the supporting surface (contact surface) between the separation aid and the core.
Figure 11:
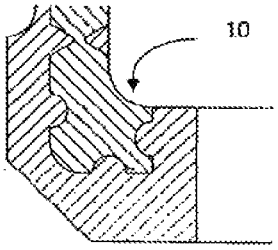

The supporting surface 10 of the separation aid 4 for core 2 can be substantially horizontal as represented in FIG. 2. It is, however, also possible for the supporting surface 10 to have an inclined or oblique supporting surface as shown in FIG. 10, or a rounded-off or rounded supporting surface as shown in FIG. 11.

Figure 12:
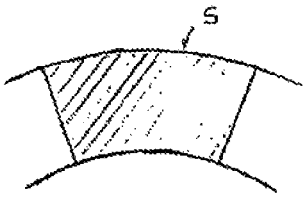
FIGS. 12 to 14 show possible geometric arrangements for the fingers of the separation aid.
Figure 13:
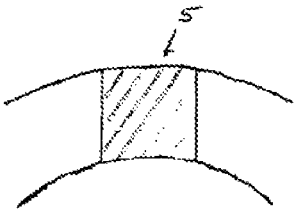
Figure 14:
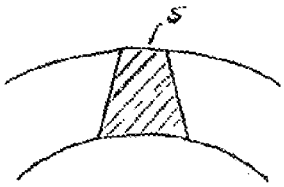

The form of the fingers 5 is also variable relative to the cross-section. The form of the fingers 5 can be pointed towards the center of the separation aid as shown in FIG. 12, or it can be parallel as shown in FIG. 13, and/or it can be externally pointed as shown in FIG. 14. In other words, as shown in FIG. 10, the sidewalls of the fingers 5 may be directed radially towards the center of the separation aid 4, or the sidewalls of the fingers 5 may be parallel to one another as shown in FIG. 13, or the sidewalls of the fingers 5 may be pointed externally so that the planes defined by the two sidewalls will intersect at a point external to the separation aid 4. It is also possible to provide the separation aid 4 with fingers 5 of differing shapes.

DEFINITION(S)

For the purpose of this disclosure, the following definition for $c_w$ value should be employed. The $c_w$ value is the air resistance coefficient in the metric system. The lower the value, the lower the resistance in the air of a projectile. The $c_w$ value is independent of projectile mass, but not the ballistic coefficient (B.C.) For example, the same projectile provided with or without a lead core has the same $c_w$ value, however, the ballistic coefficient (B.C.) is most often available in books published by projectile manufacturers.

This application incorporates by reference a certified English translation of International Application No. PCT/EP2011/004185, which is dated Jan. 28, 2013, wherein both the certified English translation and the certification are filed herewith as an Appendix.

The invention claimed is:

1. A sabot and separation aid for a projectile provided with a sub-caliber projectile core, wherein the sabot and separation aid comprise:
   (a) sabot; and
   (b) a separation aid integrated between a bottom of the projectile core and the sabot body in order to separate the sabot from the projectile core, wherein the separation aid comprises
      i. a plurality of fingers contacting the projectile core; and
      ii. a supporting surface or ring that connects the plurality of fingers with each other, wherein the supporting surface or ring is arranged below the bottom of the projectile core, and wherein at least one predetermined breaking point is provided in each finger of the plurality of fingers.

2. A sabot according to claim 1, wherein each finger includes an interior bulge that contacts the projectile core.

3. A sabot according to claim 2, wherein each finger includes one or more grooves whose shapes are selected from one or more different geometric arrangements.

4. A sabot according to claim 3, wherein a plurality of additional grooves are located in the supporting surface or ring.

5. A sabot according to claim 1, wherein each finger includes one or more grooves whose shapes are selected from one or more different geometric arrangements.

6. A sabot according to claim 5, wherein each groove has an angular shape that includes a contour selected from the group consisting of a triangular contour and a multi-angular contour, and each groove has edges selected from the group consisting of pointed edges, rounded-off edges and beveled edges.

7. A sabot according to claim 6, wherein a plurality of additional grooves are located in the supporting surface or ring.

8. A sabot according to claim 5, wherein a plurality of additional grooves are located in the supporting surface or ring.

9. A sabot according to claim 5, wherein each groove has an angular shape that includes a contour selected from the group consisting of a triangular contour and a multi-angular contour, and each groove has edges selected from the group consisting of pointed edges, rounded-off edges and beveled edges.

10. A sabot according to claim 9, wherein a plurality of additional grooves are located in the supporting surface or ring.

11. A sabot according to claim 1, wherein the supporting surface or ring includes a horizontal surface, or an inclined surface, or a rounded-off surface, or a surface that is inclined and rounded off.

12. A sabot according to claim 1, wherein a shape of each finger is predetermined relative to a cross-section so that sidewalls of each finger are pointed towards a center of the separation aid, or are parallel to each other, or are pointed to a point exterior to the separation aid.

13. A sabot according to claim 1, wherein the number of fingers as well as a length of each finger is dependent upon a diameter and length of the projectile core.

14. A projectile comprising:
   (a) a sub-caliber projectile core;
   (b) a sabot enclosing the sub-caliber projectile core; and
   (c) a separation aid integrated between a bottom of the projectile core and a bottom of the sabot in order to separate the sabot from the projectile core, wherein the separation aid comprises
      i. a plurality of fingers contacting the projectile core; and
      ii. a supporting surface or ring that connects the plurality of fingers with each other, wherein the supporting surface or ring is arranged below the bottom of the projectile core, and wherein at least one predetermined breaking point is provided in each finger of the plurality of fingers.

15. A projectile according to claim 14, wherein each finger includes an interior bulge that contacts the projectile core.

16. A projectile according to claim 15, wherein each finger includes one or more grooves whose shapes are selected from one or more different geometric arrangements that have an angular shape that includes a contour selected from the group consisting of a triangular contour and a multi-angular contour, and each groove has edges selected from the group consisting of pointed edges, rounded-off edges and beveled edges.

17. A projectile according to claim 16, wherein a plurality of additional grooves are located in the supporting surface or ring.

18. A projectile according to claim 17, wherein the supporting surface or ring includes a horizontal surface, or an inclined surface, or a rounded-off surface, or a surface that is inclined and rounded off.

19. A projectile according to claim 17, wherein a shape of each finger is predetermined relative to a cross-section so that sidewalls of each finger are pointed towards a center of the separation aid, or are parallel to each other, or are pointed to a point exterior to the separation aid.

* * * * *